US005726421A

United States Patent [19]

Fleischhauer et al.

[11] Patent Number: 5,726,421

[45] Date of Patent: Mar. 10, 1998

[54] PROTECTIVE AND CIGARETTE EJECTION SYSTEM FOR AN ELECTRICAL SMOKING SYSTEM

[75] Inventors: Grier S. Fleischhauer, Midlothian; Patrick H. Hayes, Chester; Charles T. Higgins, Richmond; Richard E. Jones, Chesterfield; Robert L. Ripley, Midlothian, all of Va.; T. Paul Beane, Maplewood, N.J.; J. Robert Nelson, Jr., Easton, Conn.

[73] Assignee: Philip Morris Incorporated, New York, N.Y.

[21] Appl. No.: 483,363

[22] Filed: Jun. 7, 1995

Related U.S. Application Data

[63] Continuation-in-part of Ser. No. 380,718, Jan. 30, 1995, Pat. No. 5,666,978, which is a continuation-in-part of Ser. No. 118,665, Sep. 10, 1993, Pat. No. 5,388,594, and Ser. No. 943,504, Sep. 11, 1992, Pat. No. 5,505,214, which is a continuation-in-part of Ser. No. 012,799, Feb. 2, 1993, Pat. No. 5,249,586, which is a continuation of Ser. No. 666,926, Mar. 11, 1991, abandoned.

[51] Int. Cl.[6] ..... A24F 13/00; B65D 83/00

[52] U.S. Cl. ..... 219/260; 219/262; 219/267; 219/269; 131/194; 131/182; 221/143; 206/249; 206/86

[58] Field of Search ..... 219/262, 260, 219/263, 267–269; 221/143, 144, 147; 206/253, 249, 85–86; 131/182, 242.5, 194, 273; 128/202.21, 200.14, 203.27

[56] References Cited

U.S. PATENT DOCUMENTS

| | | | |
|---|---|---|---|
| 1,451,235 | 4/1923 | Raje . | |
| 1,532,732 | 4/1925 | Collins . | |
| 1,551,973 | 9/1925 | Brocks . | |
| 1,743,698 | 1/1930 | Walker . | |
| 2,113,734 | 4/1938 | J. Lykos et al. . | |
| 2,256,844 | 9/1941 | Kruk | 221/143 |
| 2,355,368 | 8/1944 | Rubbio . | |
| 2,499,733 | 3/1950 | Rubbio . | |
| 2,625,163 | 1/1953 | Jones et al. . | |
| 2,742,908 | 4/1956 | Lay . | |
| 3,047,192 | 7/1962 | Sykes | 221/143 |
| 3,211,327 | 10/1965 | Beha et al. | 221/147 |
| 3,283,763 | 11/1966 | Cholet . | |
| 3,468,454 | 9/1969 | Joncas | 221/147 |
| 3,796,223 | 3/1974 | Tarrant . | |
| 4,220,256 | 9/1980 | Torri . | |
| 4,288,004 | 9/1981 | Göhringer et al. . | |
| 4,342,902 | 8/1982 | Ping | 219/268 |
| 4,844,244 | 7/1989 | Mawby . | |
| 5,060,671 | 10/1991 | Counts et al. . | |
| 5,095,921 | 3/1992 | Losee et al. . | |
| 5,113,879 | 5/1992 | Alleon . | |

(List continued on next page.)

FOREIGN PATENT DOCUMENTS

| | | | |
|---|---|---|---|
| 1006579 | 10/1984 | Belgium . | |
| 0410313 | 1/1991 | European Pat. Off. . | |
| 2 623 377 | 11/1987 | France . | |
| 1228092 | 11/1966 | Germany | 221/143 |
| 3309309 | 9/1984 | Germany . | |
| 3626992 | 2/1988 | Germany . | |
| 56-108025 | 8/1981 | Japan . | |
| 58-16125 | 1/1983 | Japan . | |
| 160721 | 3/1921 | United Kingdom . | |
| 975552 | 11/1964 | United Kingdom | 221/147 |
| 95/02970 | 2/1995 | WIPO . | |

*Primary Examiner*—John A. Jeffery
*Attorney, Agent, or Firm*—James T. Moore; James E. Schardt; Charles E. B. Glenn

[57] ABSTRACT

An ejection system is provided which has a mechanism such as a plunger which is positioned to eject at least a portion of a cigarette from the lighter cavity upon actuation by a smoker. The plunger is also positionable to occlude the lighter opening to protect the lighter cavity from dust, moisture, etc. The plunger is shaped, located and arranged to apply a force on the cigarette end inserted into the lighter. Further, an icon based indicator informs the smoker of the status of a cigarette inserted into the lighter.

23 Claims, 8 Drawing Sheets

U.S. PATENT DOCUMENTS 5,224,498 7/1993 Deevi et al. .
5,240,012 8/1993 Ehrman et al. .
5,249,586 10/1993 Morgan et al. ..... 131/194
5,265,717 11/1993 Daghestani .
5,388,594 2/1995 Counts et al. .
5,505,214 4/1996 Collins et al. ..... 131/194

PROTECTIVE AND CIGARETTE EJECTION SYSTEM FOR AN ELECTRICAL SMOKING SYSTEM

CROSS REFERENCE TO RELATED APPLICATIONS

The present application is a continuation-in-part of commonly assigned patent application Ser. No. 08/380,718, filed Jan. 30, 1995, now U.S. Pat. No. 5,666,978, which in turn is a continuation-in-part of patent application Ser. No. 08/118,665, filed Sep. 10, 1993, now U.S. Pat. No. 5,388,594 issued Feb. 14, 1995 and is a continuation-in-part of commonly assigned patent application Ser. No. 07/943,504, filed Sep. 11, 1992, (now U.S. Pat. No. 5,505,214 issued Apr. 9, 1996, which in turn is a continuation-in-part of patent application Ser. No. 07/666,926 filed Mar. 11, 1991, now abandoned in favor of filewrapper continuation application Ser. No. 08/012,799, filed Feb. 2, 1993, which is now U.S. Pat. No. 5,249,586 issued Oct. 5, 1993.

The present application relates to commonly assigned patent application Ser. No. 07/943,747, which is now U.S. Pat. No. 5,369,723, issued Nov. 29, 1994; and patent application Ser. No. 08/224,848, filed Apr. 8, 1994 (now abandoned); Ser. No. 08/225,120, filed Apr. 8, 1994 (now U.S. Pat. No. 5,613,505; Ser. No. 08/333,470 filed Nov. 2, 1994 (now U.S. Pat. No. 5,530,225 issued Jun. 25, 1996); Ser. No. 08/314,463, filed Sep. 28, 1994 (now U.S. Pat. No. 5,573,892 issued Nov. 12, 1996) and U.S. Ser. No. 08/370,125, filed Jan. 9, 1995 and to commonly assigned U.S. Pat. No. 5,060,671, issued Oct. 29, 1991; U.S. Pat. No. 5,095,921, issued Mar. 17, 1992; and U.S. Pat. No. 5,224,498, issued Jul. 6, 1992.

The present application further relates to commonly assigned, U.S. patent application Ser. No. 08/365,952, filed Dec. 29, 1994, entitled "Aluminum Containing Iron-Base Alloys Useful as Electrical Resistance Heating Elements" (Attorney Docket No. PM 1767, now U.S. Pat. No. 5,595,706, issued Jan. 21, 1997), to Ser. No. 08/425,166, filed Apr. 20, 1995, entitled "Cigarette for Electrical Smoking System" (Attorney Docket No. PM 1759A), to Ser. No. 08/425,837, filed Apr. 20, 1995, entitled "Cigarette for Electrical Smoking System" (Attorney Docket No. PM 1759B, now U.S. Pat. No. 5,499,636, issued Mar. 19, 1996), Ser. No. 08/426,165, filed Apr. 20, 1995, entitled "Heater for Use in an Electrical Smoking System" (Atty. Docket No. PM 1768, now U.S. Pat. No. 5,591,360, issued Jan. 7, 1997), and to Ser. No. 08/426,006, filed Apr. 20, 1995, entitled "Iron Aluminide Alloys Useful as Electrical Resistance Heating Elements" (Attorney Docket No. PM 1769); and to commonly assigned U.S. Pat. No. 5,408,574, issued Apr. 18, 1995, which is a continuation-in-part of commonly assigned U.S. Pat. No. 5,224,498, issued Jul. 6, 1993, which is a continuation-in-part of commonly assigned U.S. Pat. No. 5,093,894, issued Mar. 3, 1992.

All of these referenced and related patents and applications are hereby incorporated by reference in their entireties.

BACKGROUND OF THE INVENTION

1. Technical Field of the Invention

The present invention relates to methods and apparatuses for protecting an electrical lighter and for ejecting cigarettes from an electrical lighter.

2. Discussion of the Related Art

Previously known conventional lit cigarettes deliver flavor and aroma to the user as a result of combustion of tobacco. A mass of combustible material, primarily tobacco, is oxidized as the result of applied heat with typical combustion temperatures in a conventional lit cigarette being more than 800° C. during puffing. Heat is drawn through an adjacent mass of tobacco by drawing on the mouth end. During this heating, inefficient oxidation of the combustible material takes place and yields various distillation and pyrolysis products. As these products are drawn through the body of the lit cigarettes toward the mouth of the smoker, they cool and condense to form an aerosol or vapor that gives the consumer the flavor and aroma associated with smoking.

Conventional lit cigarettes have various perceived drawbacks associated with them. Among them is the production of sidestream smoke during smoldering between puffs, which may be objectionable to some non-smokers. Also, once lit, they must be fully consumed or be discarded. Relighting a conventional cigarette is possible but is usually an unattractive prospect for subjective reasons (flavor, taste, odor) to a discerning smoker.

A prior alternative to the more conventional lit cigarettes includes those in which the combustible material itself does not directly provide the flavorants to the aerosol inhaled by the smoker. In these lit cigarettes, a combustible heating element, typically carbonaceous in nature, is combusted to heat air as it is drawn over the heating element and through a zone that contains heat-activated elements that release a flavored aerosol. While this type of lit cigarette produces less sidestream smoke, it still generates products of combustion, and once lit it is not adapted to be snuffed for future use in the conventional sense.

In both the more conventional lit cigarettes and lit carbon element cigarettes described above combustion takes place during their use. This process naturally gives rise to many by-products as the combusted material breaks down and interacts with the surrounding atmosphere.

Several proposals have been advanced which significantly reduce undesired sidestream smoke while permitting the smoker to suspend smoking of the cigarette for a desired period and then to resume smoking. Commonly assigned U.S. Pat. Nos. 5,093,894; 5,225,498; 5,060,671 and 5,095,921 disclose various electrical resistive heating elements and flavor generating systems which significantly reduce sidestream smoke while permitting the smoker to selectively suspend and reinitiate smoking. U.S. Pat. No. 5,388,594, issued Feb. 14, 1995, U.S. patent application Ser. No. 08/380,718, filed Jan. 30, 1995; Ser. No. 08/425,166, filed Apr. 20, 1995, entitled "Cigarette for Electrical Smoking System" (Attorney Docket No. PM 1759A); Ser. No. 08/425,837, filed Apr. 20, 1995, entitled "Cigarette for Electrical Smoking System" (Attorney Docket No. PM 1759B); and Ser. No. 08/426,165, filed Apr. 20, 1995, (Atty. Docket No. PM 1768) describe electrical smoking systems including novel electrically powered lighters and novel cigarettes adapted to cooperate with the lighter. The preferred embodiment of the lighter includes a plurality of metallic sinusoidal heaters disposed in a configuration that slidingly receives a tobacco rod portion of the cigarette. One of the many advantages of such smoking systems is the reusability of the lighter for numerous cigarettes.

In the above noted electrical smoking systems, the cigarette is manually removed from the lighter by the smoker. Since the heated sections of the inserted cigarette are not visible to a smoker during use, a visual indication of the status of the cigarette is desirable, especially if smoking of a particular cigarette is suspended for a period of time. Also, relatively tight interfaces between the cigarette and heater blades, e.g., inwardly biased blades, are desired for good thermal transfer to the cigarette, but may require a forceful pulling by the smoker to withdraw the cigarette, potentially damaging the heater assembly, electrical connections, etc. Also, this withdrawal could possibly break the thermally weakened cigarette, thereby complicating, if not frustrating, cigarette removal and potentially leaving cigarette remnants in the lighter which may block insertion of subsequent cigarettes or affect subjective qualities of subsequently smoked cigarettes.

Once the cigarette is removed in the above noted electrical smoking systems, the smoker may opt to suspend use and to store the lighter in or on a pocket, purse, glove compartment, drawer, desktop, console, countertop, etc. Dust, moisture, etc. could enter the open cigarette insertion opening of the lighter and possibly damage components and/or alter subjective qualities of subsequently inserted cigarettes.

OBJECTS OF THE INVENTION

Accordingly, it is an object of the present invention to provide an ejection system to assist in the ejection of cigarettes from an electrical lighter.

It is another object of the present invention to protect internal components of an electrical lighter from potentially damaging dust, moisture, etc.

It is a further object of the present invention to provide desired positioning of a cigarette inserted into an electrical lighter.

It is another object of the present invention to provide desired air flow to a cigarette inserted into an electrical lighter.

It is a further object of the present invention to indicate the status of various operations of an electrical lighter.

It is another object of the present invention to accomplish the foregoing objects in a hand held electrical lighter.

It is further object of the present invention to accomplish the foregoing objects simply and in a straightforward manner.

Additional objects and advantages of the present invention are apparent from the drawings and specification which follow.

SUMMARY OF THE INVENTION

The foregoing and additional objects are obtained by an electrical cigarette lighter according to the present invention. An ejector system is provided comprising a mechanism such as a plunger which is positioned to eject at least a portion of a cigarette from the lighter cavity upon actuation by a smoker. The plunger is also positionable to occlude the lighter opening to protect the lighter cavity from dust, moisture, etc. The plunger is shaped, located and arranged to apply a force on the cigarette end inserted into the lighter. Further, an icon based indicator is provided to inform the smoker of the status of a cigarette inserted into the lighter.

DETAILED DESCRIPTION OF THE PREFERRED EMBODIMENTS

Figure 1:
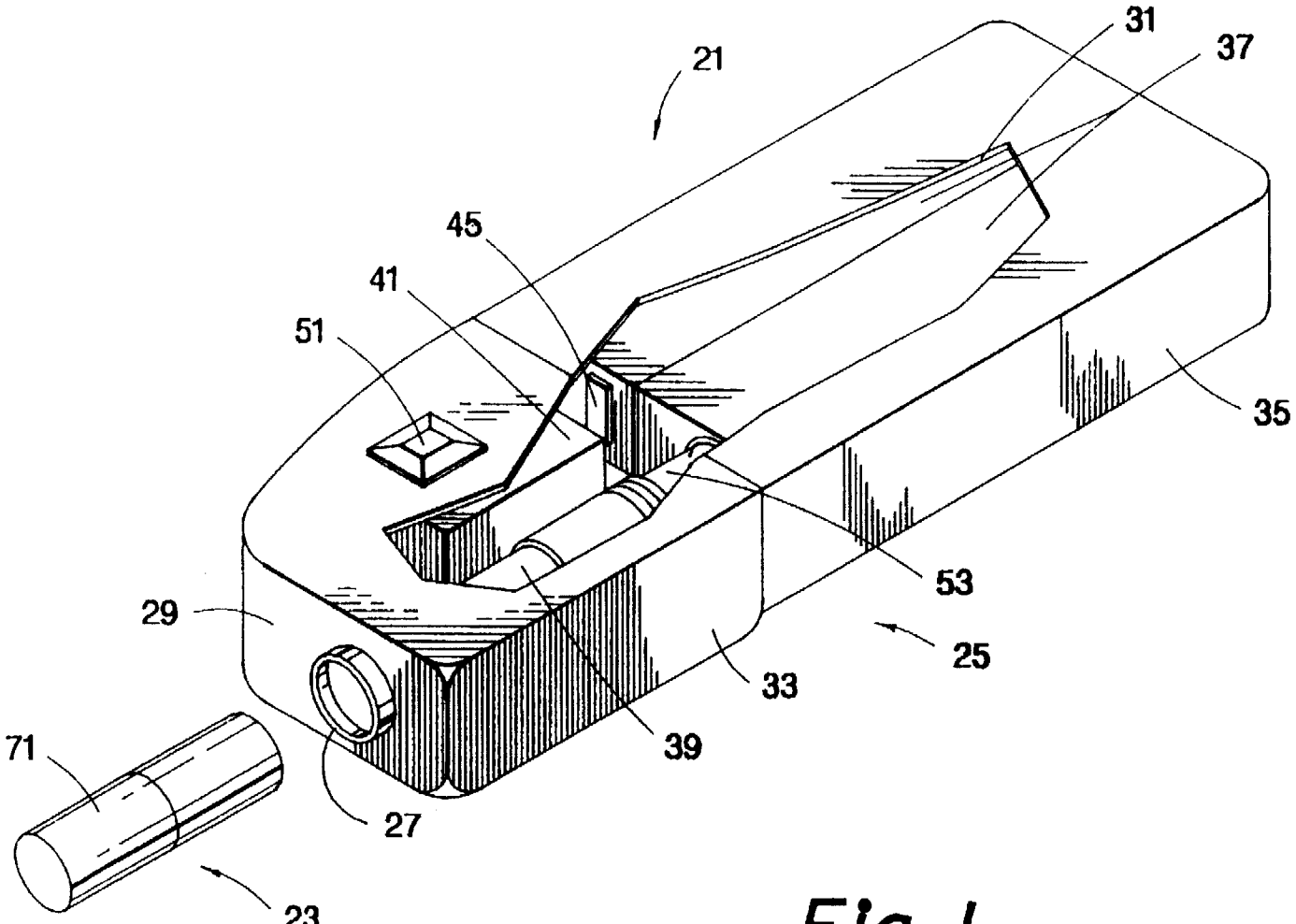
FIG. 1 is a partially exposed perspective view of an electrical smoking system according to the present invention comprising a lighter and cigarette.

A smoking system 21 according to the present invention is generally seen with reference to FIG. 1, and is described in greater detail in U.S. Pat. No. 5,388,594 and Ser. No 08/380,718, filed Jan. 30, 1995 which are hereby incorporated by reference in their entireties. The present invention is discussed in greater detail with reference to FIGS. 2A–4.

The smoking system 21 includes a cigarette 23 and a reusable lighter 25. The cigarette 23 is adapted to be inserted in and removed from an orifice 27 at a front end 29 of the lighter 25. The smoking system 21 is used in much the same fashion as a conventional lit cigarette. The cigarette 23 is disposed of after one or more puff cycles. The lighter 25 is preferably disposed of after a greater number of puff cycles than the cigarette 23.

The lighter 25 includes a housing 31 and has front and rear portions 33 and 35. A power source 37 for supplying energy to heating elements for heating the cigarette 23 is preferably disposed in the rear portion 35 of the lighter 25. The rear portion 35 is preferably adapted to be easily opened and closed, such as with screws or with snap-fit components, to facilitate replacement of the power source 37. The front portion 33 preferably houses heating elements and circuitry in electrical communication with the power source 37 in the rear portion 35. The front portion 33 is preferably easily joined to the rear portion 35, such as with a dovetail joint or by a socket fit. The housing 31 is preferably made from a hard, heat-resistant material. Preferred materials include metal-based or, more preferably, polymer-based materials. The housing 31 is preferably adapted to fit comfortably in the hand of a smoker and, in one embodiment, has overall dimensions of 10.7 cm by 3.8 cm by 1.5 cm.

The power source 37 is sized to provide sufficient power for heating elements that heat the cigarette 23. The power source 37 is preferably replaceable and rechargeable and may include devices such as a capacitor, or more preferably, a battery. In a presently preferred embodiment, the power source is a replaceable, rechargeable battery such as four nickel cadmium battery cells connected in series with a total, non-loaded voltage of approximately 4.8 to 5.6 volts. The characteristics required of the power source 37 are, however, selected in view of the characteristics of other components in the smoking system 21, particularly the characteristics of the heating elements. U.S. Pat. No. 5,144,962 describes several forms of power sources useful in connection with the smoking system of the present invention, such as rechargeable battery sources and quick-discharging capacitor power sources that are charged by batteries, and is hereby incorporated by reference.

Figure 2A:
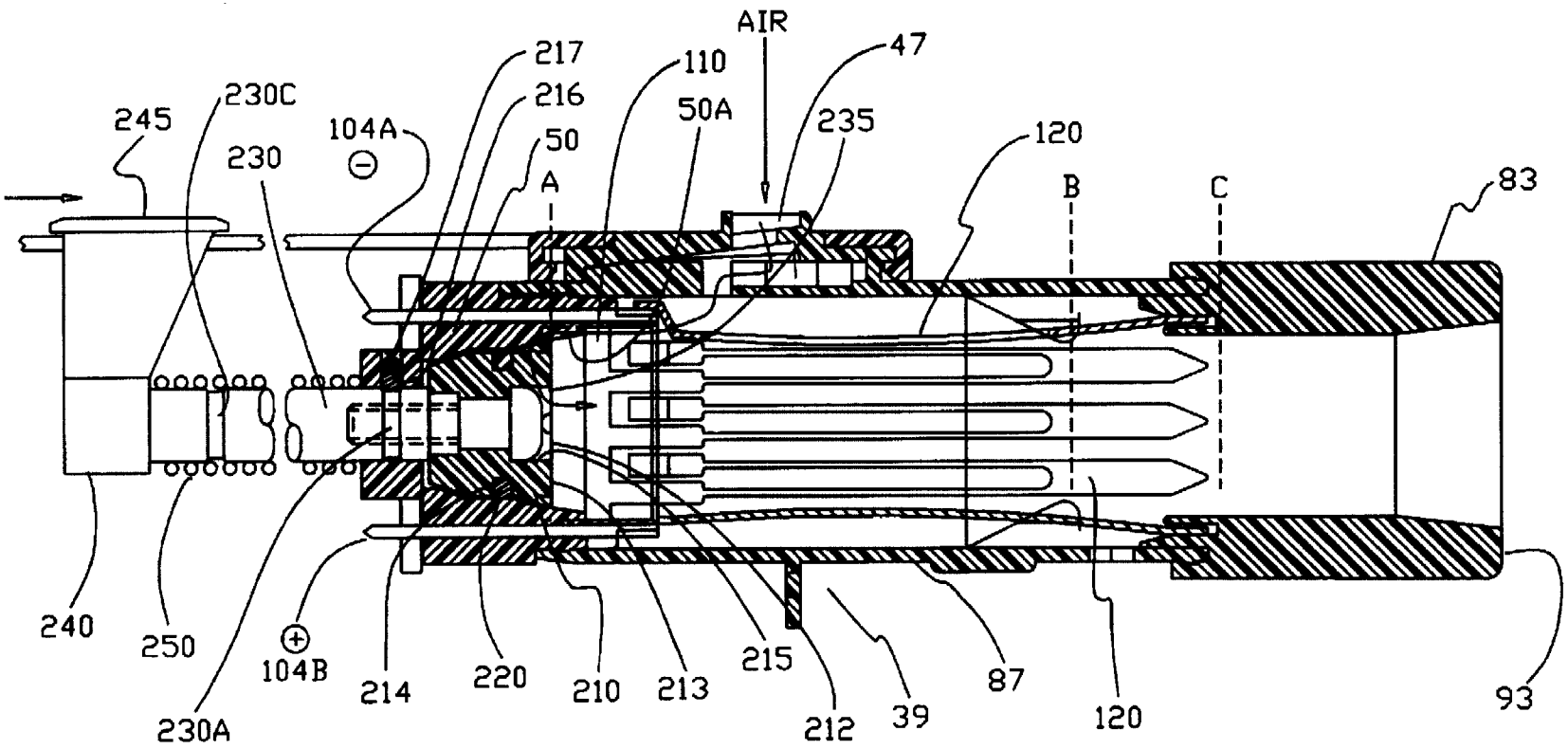
FIG. 2A is a side, cross-sectional view of a heater fixture of a lighter including an ejection mechanism according to the present invention shown in a retracted or operational position.

A substantially cylindrical heating fixture 39 for heating the cigarette 23, and, preferably, for holding the cigarette in place relative to the lighter 25, and electrical control circuitry 41 for delivering a predetermined amount of energy from the power source 37 to cigarette heating elements 120 of the heating fixture are preferably disposed in the front 33 of the lighter. As described in greater detail in commonly assigned, copending U.S. patent application Ser. No. 08/426,165, filed Apr. 20, 1995, entitled "Heater for Use in an Electrical Smoking System" (Atty. Docket No. PM 1768), a generally circular, terminal end hub 110 is fixed, e.g., welded, to be disposed within the interior of cigarette heater fixture 39, e.g., is fixed to base 50, as shown in FIG. 2A. In the presently preferred embodiment, the heating fixture 39 includes a plurality of equally or unequally radially-spaced heating blades 120 supported to extend from the hub, seen in FIG. 2A(i), which are individually energized by the power source 37 under the control of the circuitry 41 to heat a number of, e.g., eight, areas around the periphery of the inserted cigarette 23. Eight heating blades 120 are preferred to develop eight puffs as in a conventional lit cigarette and eight cigarette heater elements also lend themselves to electrical control with binary devices. A desired number of puffs can be generated, e.g., any number between 5–16, and preferably 6–10 or 8, per inserted cigarette. The heating elements 120 can comprise any suitable heating element for heating tobacco to evolve tobacco flavors. For example, the heating system can comprise any of the resistance and induction heating systems disclosed in U.S. Pat. No. 5,388,594 and application Ser. No. 08/380,718, filed Jan. 30, 1995; Ser. No. 08/225,120, filed Apr. 8, 1994; Ser. No. 08/224,848, filed Apr. 8, 1994; Ser. No. 08/314,463, filed Sep. 28, 1994 Ser. No. 08/333,470 filed Nov. 2, 1994; Ser. No. 08/370,125, filed Jan. 9, 1995 and Ser. No. 08/426,165, filed Apr. 20, 1994, entitled "Heater for Use in an Electrical Smoking System" (Atty. Docket No. PM 1768).

The circuitry 41 is preferably activated by a puff-actuated sensor 45, seen in FIG. 1, which is sensitive to pressure drops that occur when a smoker draws on the cigarette 23. The puff-actuated sensor 45 is preferably disposed in the front 33 of the lighter 25 and communicates with a space inside the cigarette heater fixture 39 and near the cigarette 23 through a passageway extending through a spacer and a base of the cigarette heater fixture and, if desired, a puff sensor tube (not shown). A puff-actuated sensor 45 suitable for use in the smoking system 21 is described in U.S. Pat. No. 5,060,671, the disclosure of which is incorporated by reference, and is in the form of a Model 163PCO1D35 silicon sensor, manufactured by the MicroSwitch division of Honeywell, Inc., Freeport, Ill., which activates an appropriate one of the cigarette heater elements or blades 120 as a result of a change in pressure when a smoker draws on the cigarette 23.

An indicator 51 is preferably provided on the exterior of the lighter 25, preferably on the front 33, to indicate the number of puffs remaining on a cigarette 23 inserted in the lighter. In one embodiment, the indicator 51 preferably includes a seven-segment liquid crystal display. In this embodiment, the indicator 51 displays the digit "8" for use with an eight-puff cigarette when a light beam emitted by a light sensor 53, seen in FIG. 1, is reflected off the front of a newly inserted cigarette 23 and detected by the light sensor. The light sensor 53 is preferably mounted in an opening in the spacer and the base of the cigarette heater fixture 39. The light sensor 53 provides a signal to the circuitry 41 which, in turn, provides a signal to the indicator 51. For example, the display of the digit "8" on the indicator 51 reflects that the preferred eight puffs provided on each cigarette 23 are available, i.e., none of the heaters have been activated to heat the new cigarette. A counter is provided to count the number of blade firings to update the numeric indicator of display 51. After the cigarette 23 is fully smoked, the indicator displays the digit "0". An alternate display is described below in reference to FIG. 3A. When the cigarette 23 is removed from the lighter 25, the light sensor 53 does not detect the presence of a cigarette 23 and the indicator 51 is turned off. The light sensor 53 is modulated so that it does not constantly emit a light beam and provide an unnecessary drain on the power source 37. A presently preferred light sensor 53 suitable for use with the smoking system 21 is a Type OPR5005 Light Sensor, manufactured by OPTEX Technology, Inc., 1215 West Crosby Road, Carrollton, Tex. 75006.

As one of several possible alternatives to using the above-noted light sensor 53, a mechanical switch (not shown) may be provided to detect the presence or absence of a cigarette 23 and a reset button may be provided for resetting the circuitry 41 when a new cigarette is inserted in the lighter 25, e.g., to cause the indicator 51 to display the digit "8", other icons as described below, etc. Power sources, circuitry, puff-actuated sensors, and indicators useful with the smoking system 21 of the present invention are described in U.S. Pat. No. 5,060,671 and U.S. patent application Ser. Nos. 07/943,504 and 08/380,718, filed Jan. 30, 1995, which are incorporated by reference.

A presently preferred cigarette 23 for use with the smoking system 21 is described and shown in greater detail in U.S. Pat. No. 5,388,594 and Ser. Nos. 08/380,718, filed Jan. 30, 1995, and Ser. No. 08/425,166, filed Apr. 20, 1995, entitled "Cigarette for Electrical Smoking System" (Attorney Docket No. PM 1759A), and Ser. No. 08/425,837, filed Apr. 20, 1995, entitled "Cigarette for Electrical Smoking System" (Attorney Docket No. PM 1759B), which are hereby incorporated by reference in their entireties, although any suitable cigarette can be employed.

The cigarette heater fixture is disposed in the orifice 27 in the lighter 25. The cigarette 23 is inserted, tobacco end first, in the orifice 27 in the lighter 25 into a substantially cylindrical space of the cigarette heater fixture 39 defined by a ring-shaped cap 83 having an open end for receiving the cigarette, a cylindrical air channel sleeve 87, a heater assembly including the heater blades 120, an electrically conductive pin or common lead 104A, which serves as a common lead for the heater elements of the heater assembly, electrically conductive positive pins or leads 104B, and the spacer.

Substantially all of the cigarette heater fixture 39 is disposed inside and secured in position by a snug fit with the housing 31 of the front 33 of the lighter 25. A forward edge 93 of the cap 83 is preferably disposed at or extending slightly outside the first end 29 of the lighter 25 and preferably includes an internally beveled or rounded portion to facilitate guiding the cigarette 23 into and out of the heater fixture 39. The pins 104A and 104B are preferably received in corresponding sockets (not shown), thereby providing support for the cigarette heater fixture 39 in the lighter 25, and conductors or printed circuits lead from the socket to the various electrical elements. Other pins can provide additional support to strengthen the pin assembly. The pins 104A and 104B can comprise any suitable material and preferably comprise tinned phosphorous bronze.

Each blade 120 forms a resistive heater element in the depicted embodiment. More specifically, the first end of first blade section is electrically connected to the negative terminal of the power supply, and more specifically is an integral extension of hub 110 or is mechanically and electrically connected to hub 110, which in turn is in electrical and mechanical connected to negative terminal pin 104A via tack welding or another technique such as brazing or soldering. Preferably, two terminal pins 104A are used to provide a balanced support since the negative and positive connections also serve to mechanically support the heater. The hub 110 thus functions as an electrical common for all of the heater blades 120. In any of the embodiments, the negative connection for each heater can be made individually by, e.g., an appropriate negative contact deposited on an end of the heater opposite the respective positive contact areas. A respective positive connection for each heater blade 120 is made at connecting end section of the second blade section as discussed in Ser. No. 08/426,165, filed Apr. 20, 1995, entitled "Heater for Use in an Electrical Smoking System" (Atty. Docket No. PM 1768). Blade end sections can flare outward to define a throat section.

Figure 5:
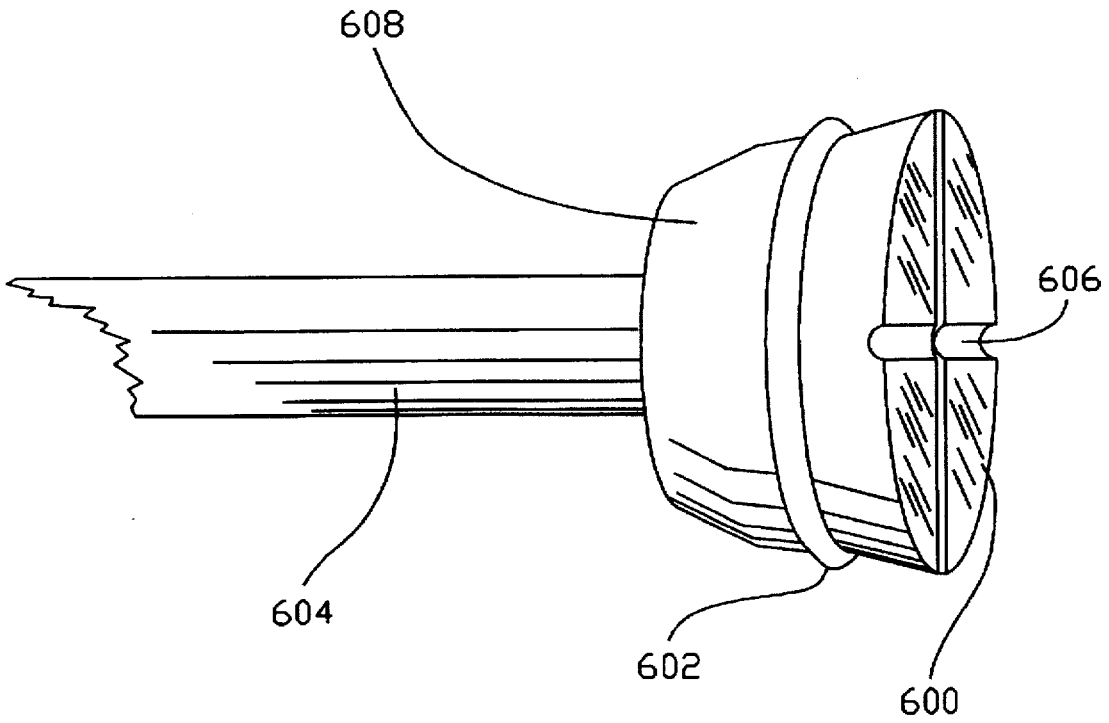
FIG. 5 is a perspective view of an ejector structure according to the invention.

Referring to FIGS. 2A–3C, an ejection system according to the present invention is shown. As best seen in FIGS. 2A–2D, a plunger 210 is provided having a front face 212. As described in greater detail below, the plunger 210 is positionable in three positions within lighter 25, namely a retracted or operational position A, a first extended or eject position B and a second extended or protective position C. As discussed below, positions B and C can be combined. In retracted or operational position A, plunger 210 is positioned in a cavity 50A defined by base 50 with sufficient spacing, e.g., approximately 3 mils clearance, such that plunger 210 is movable from a retracted position A out of cavity 50A to position B and is movable back into cavity 50A to its retracted position A. For example, as shown the front end of plunger 210 has a larger diameter than rearward portions, and base 50 defines a corresponding shape within cavity 50A, whereby a stop is formed for the plunger 50 in the resting position A. Referring to FIG. 5, a groove 214 is formed on the outer surface of plunger 210 and is fitted with an O-ring 220 to form an air tight seal between the slightly spaced apart cavity 50A and sides of plunger 210. These features are also illustrated in FIG. 5. The groove 606 is visible on surface 600, while O-ring 602 surrounds the plunger 608. Plunger 608 is mounted on rod 604.

Figure 3C:
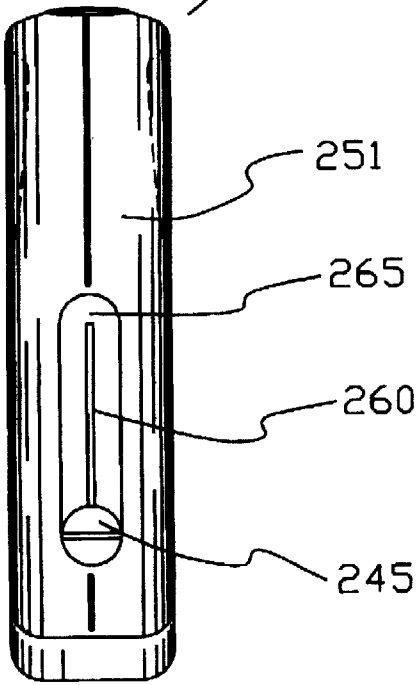
FIG. 3C is a side view of a lighter including an actuation switch for an ejection mechanism according to the present invention.
Figure 3B:
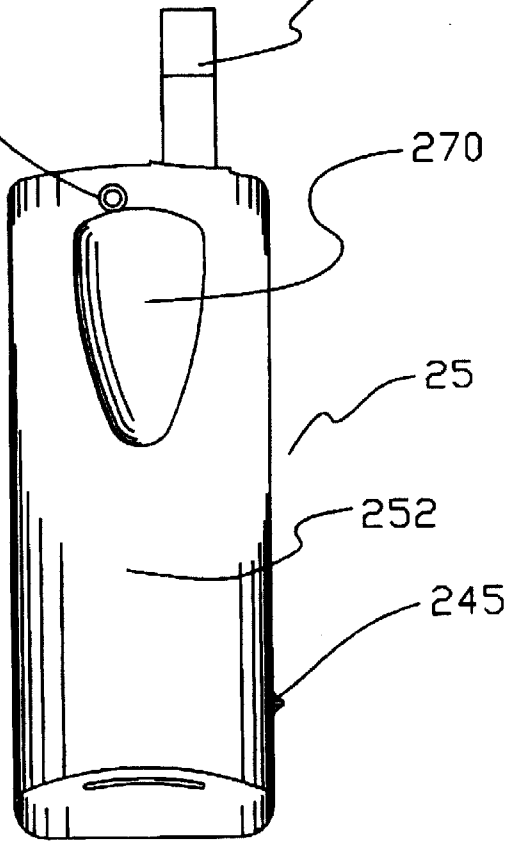
FIG. 3B is a side view of a lighter including a thumb depression according to the present invention.

Plunger 210 is connected to an arm 230 in any manner. For example, a shoulder pin 235, e.g., having a conventional Phillips type head, is inserted into a cavity 215 defined in the plunger front face 212 and is press fitted through plunger 210 and into a terminal end of arm 230. Arm 230 in turn is connected to a sliding actuator 240 comprising a button or switch 245 for manual actuation. Preferably, sliding actuator 240 is shaped such that an active surface of switch 245 is substantially parallel with arm 230. Switch 245 is accessible to the smoker and preferably is positioned in a slot or track 260 defined in the outer surface of the lighter housing, as shown in FIG. 3C. Track 260 is preferably located in a recessed area 265 of the lighter outer surface such that only the active surface of switch 245 protrudes above the plane of the lighter outer surface, and specifically track 260 is located in and switch 245 protrudes above one of two narrower walls of the generally rectangular housing of lighter 25. A spring 250 is provided which is spiralled about arm 230 between sliding actuator 240 and base 50. Spring 250 is compressed as sliding actuator 240 moves toward base 50 to move plunger 210 from retracted position A out of cavity 50A to positions B and/or C.

Arm 230 is provided with three circumferential grooves or detents 230A, 230B and 230C formed in an outer surface thereof. A ball 216 is provided which is spring biased by a spring 217 located in a cavity of base 50. Spring biased ball 216 thus forms a ball-detent relationship with a selected one of the detents 230A, 230B and 230C by exerting sufficient force thereon such that spring biased ball 216 holds arm 230 stationary against the compressive force of spring 250. Detents 230A, 230B and 230C are spaced apart on the outer surface of arm 230 to correspond respectively to (1) retracted or operational position A, (2) first extended or eject position B and (3) second extended or protective position C of the plunger 210 connected to an end thereof. The holding force of spring biased ball 216 is overcome by the smoker manually or otherwise actuating switch 245 in the desired direction to move a detent out of engagement with spring biased ball 216 and to move another detent of arm 230 into engagement with spring biased ball 216, thereby stationarily positioning plunger 210 at a subsequent corresponding position A, B or C as desired. This desired plunger position is either the adjacent or the third remaining position.

A passageway 47 provides airflow to the heater fixture 39, preferably via a side wall of the lighter housing such that air is directed at the sides of an inserted cigarette. Puff-actuated sensor 45 is preferably located in this passageway 47. The light sensor 53 senses the presence or absence of a cigarette 23 in the lighter 25.

To operate the lighter 25, the smoker first positions switch 245 at the position, e.g., most distal from lighter opening or orifice 27, which corresponds to retracted or operational position A of plunger 210 to permit insertion of the cigarette 23 into the cylindrical cavity defined by the heater blades 120, as shown in FIG. 2A. More specifically, the ejection system is disposed such that (1) position A of plunger 210 is located at the distal end of the cylindrical cigarette receptacle defined by the heater blades 120, i.e., opposite the insertion opening, (2) the distal inserted cigarette end abuts plunger front face 212, and (3) the cigarette 23 is positioned as desired relative to heater blades 120. For example, the cigarette 23 could be positioned such that the heater blades 120 are disposed adjacent a cavity in the cigarette, and in a preferred embodiment are disposed as described in commonly assigned copending patent application Ser. No. 08/425,166, filed Apr. 20, 1995, entitled "Cigarette for Electrical Smoking System" (Atty. Docket No. PM 1759A) and commonly assigned copending patent application Ser. No. 08/425,837, filed Apr. 20, 1995, entitled "Cigarette for Electrical Smoking System" (Atty. Docket No. PM 1759B). The inserted cigarette end preferably abuts plunger front face 212 such that center air flow through the cigarette from this inserted end is substantially blocked, whereby upon drawing air flow is directed primarily transversely through the cigarette sides, especially via previously heated cigarette sections. If the interface between the plunger front face 212 and the inserted cigarette end is airtight, then the cigarette rod could collapse or otherwise perform unsatisfactorily, especially at the first puff prior to heating sections to provide apertures for transverse air flow. Accordingly, some air flow is directed from the sides of the plunger 210, between plunger front face 212 and the inserted cigarette end, and longitudinally through the cigarette, e.g., via a circumferential gap therebetween or via a groove or grooves 213 formed in plunger 210. For example, plunger 210 is positioned in the lighter 25 such that, upon insertion of the cigarette 23, the first puff has a resistance to draw of approximately 5 to approximately 12 inches of water, e.g., approximately 9 inches of water, and subsequent puffs have a resistance to draw of approximately 3 to approximately 8 inches of water, e.g., approximately 5 inches of water, as transverse air flow increases. In another preferred embodiment, the first puff has a resistance to draw which is approximately 1 inch of water greater than that of the subsequent puffs. This air flow is shown via an arrow ended line in FIG. 2A.

The cigarette is then smoked as described in greater detail in U.S. Pat. No. 5,388,594 and Ser. No 08/380,718, filed Jan. 30, 1995, which are hereby incorporated by reference in their entireties, e.g., by the smoker drawing on the mouthpiece to actuate a puff sensor and one of the heater blades 120 to heat a section of the inserted cigarette to generate a puff of smoke for delivery to the smoker. With each puff, display 51 preferably updates the current status, e.g., puffs taken or puffs remaining, of the particular cigarette.

Figure 2B:
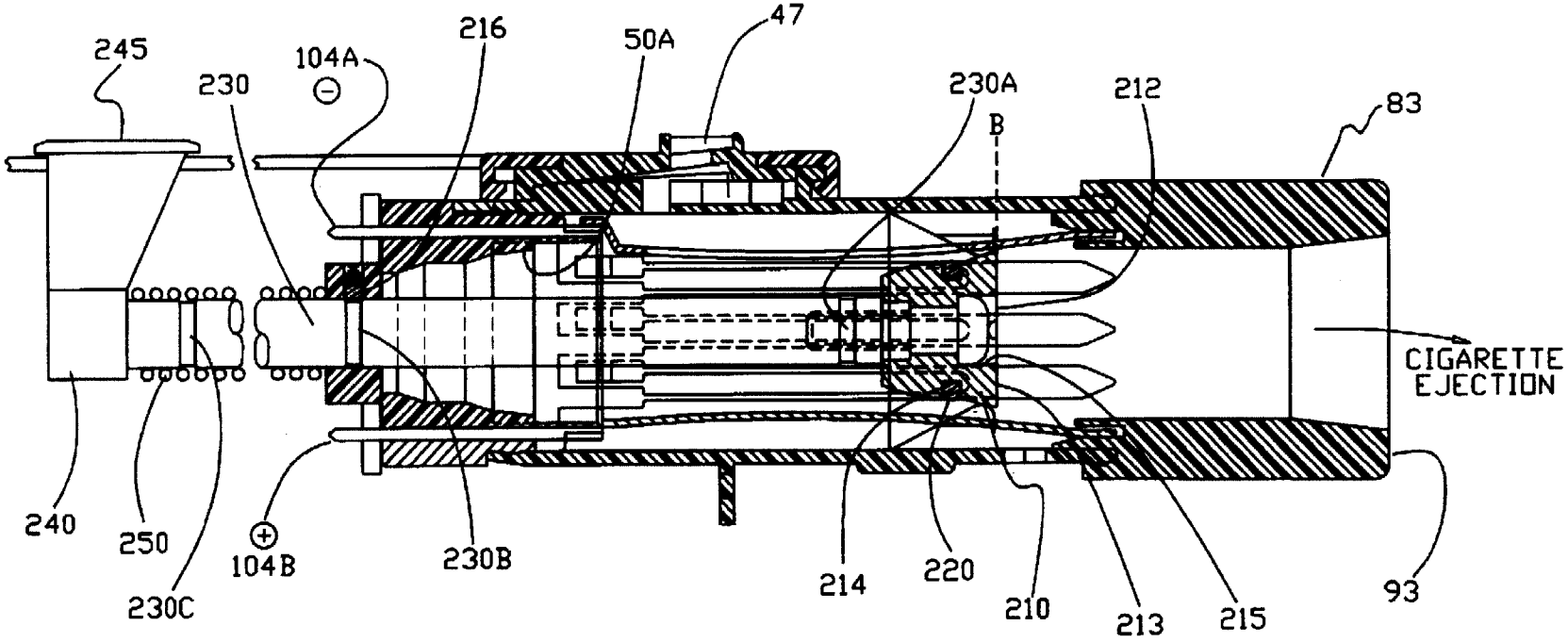
FIG. 2B is a side, cross-sectional view of a heater fixture of a lighter including an ejection mechanism according to the present invention shown in a first extended or eject position.

When a smoker has smoked a predetermined number of puffs, e.g., eight puffs, the indicator display 51 indicates that the cigarette 23 is finished. To remove the cigarette from the lighter 25, the smoker actuates, e.g., manually actuates, the switch 245 and specifically pushes switch 245 in the direction of cigarette ejection, i.e., towards the opening or orifice 27 of lighter 25, to disengage spring biased ball 216 from arm detent 230A to move from (a) a switch position corresponding to resting or "smoking" position A of plunger 210 to (b) a switch position corresponding to first extended or eject position B of plunger 210, as shown in FIG. 2B. Plunger 245 accordingly translates in this ejection direction and pushes against the inserted end of cigarette 23 to move the inserted end of cigarette 23 toward opening 27, thereby at least partially ejecting the cigarette 23. For clarity, the direction of cigarette ejection is represented by an arrow in FIG. 2B, and cigarette 23 is accordingly not shown. Spring 250 is compressed as sliding actuator 240 moves toward base 50 to brake the motion of plunger 210 toward opening or orifice 27. Actuation of switch 245 continues until spring biased ball 216 engages arm detent 230B to position plunger temporarily and stationarily at first extended or eject position B. First extended or eject position B is located within the cylindrical cavity defined by the heater blades 120 at a sufficient distance from position A to eject at least a portion of the smoked cigarette 23 from the cylindrical cavity and ultimately from the lighter 25.

This distance from position A to position B can either be sufficient to eject the smoked cigarette 23 completely from the lighter 25 or to eject an adequate portion of cigarette 23 from lighter 25 to enable the smoker to remove the thermally weakened smoked cigarette with minimal risk of breaking the cigarette, e.g., approximately 50 to 55 mm. of cigarette 23 should be ejected. Preferably, a portion of cigarette 23 remains in lighter 25 until grasped by the smoker to prevent the cigarette 23 from being completely ejected from the lighter forcibly and/or prematurely.

It is noted that it is not always necessary for plunger 210, and thus switch 245, to be stationarily positioned at eject position B, i.e., detent 230B need not be engaged and thus could be optionally eliminated. Alternatively, switch 245 and thus plunger 210 is moved from position A to position B to eject the cigarette, and then switch 245 is released, causing spring 250 to expand and drive sliding actuator 240, and thus plunger 210 and switch 245, from position B back to position A.

After ejection of the smoked cigarette, the lighter 25 is ready for insertion of another cigarette and the described smoking process repeated. If necessary, spring biased ball 216 is disengaged from detent 230B by actuation of switch 245, e.g., away from orifice 27. Switch 245 is preferably and conveniently released after being translated a sufficient distance to disengage biased ball 216 from detent 230B, permitting spring 250 to expand and drive sliding actuator 240, and thus plunger 210 and switch 245, from position B back to position A.

Figure 2C:
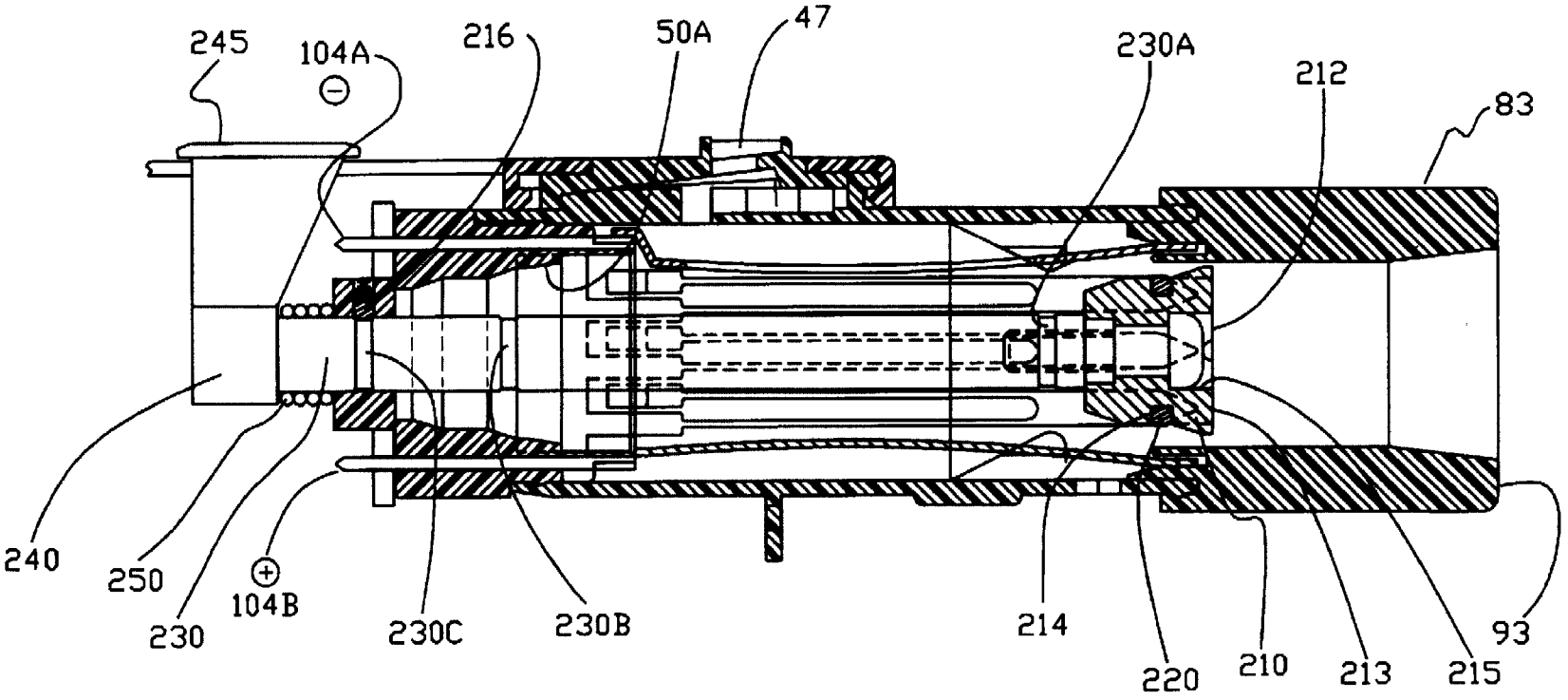
FIG. 2C is a side, cross-sectional view of a heater fixture of a lighter including an ejection mechanism according to the present invention shown in a second extended or protective position.
Figure 2D:
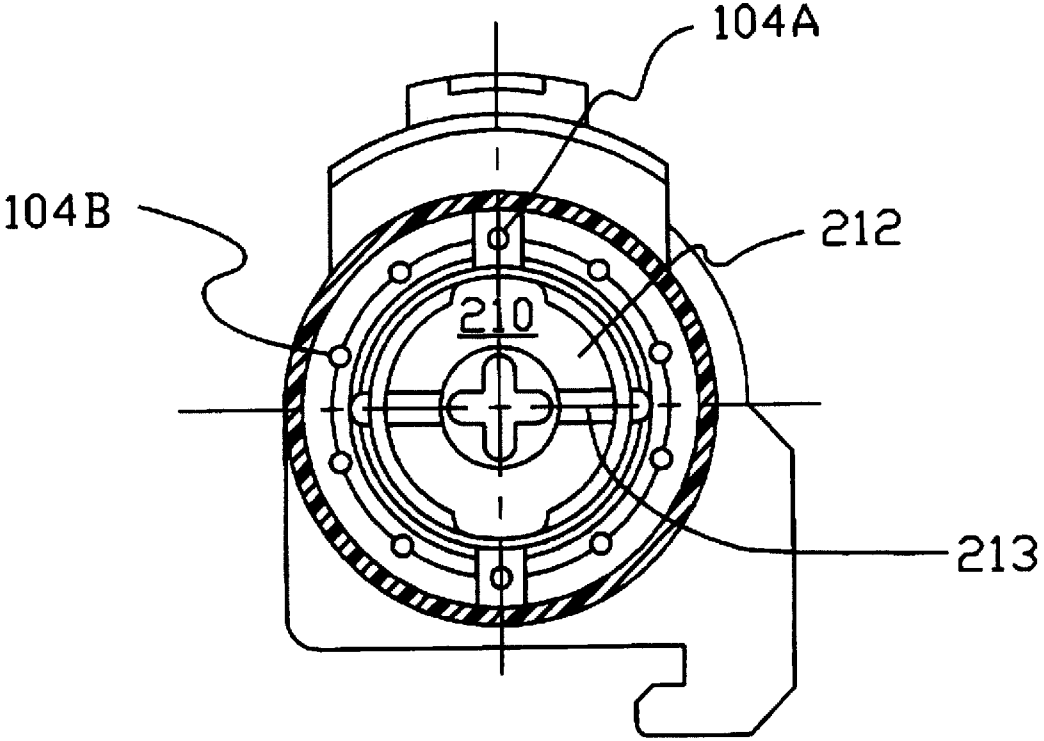
FIG. 2D is a front view of a heater fixture of a lighter including an ejection mechanism according to the present invention.

Plunger 210, and specifically plunger front face 212 facing and abutting the inserted end of cigarette 23 as described in operational or resting position A, exerts a substantially uniformly distributed force on the inserted, substantially circular end of the substantially cylindrical cigarette as the switch 245, and thus the plunger 210, is actuated to move the cigarette out of the lighter cavity. This even application of force is achieved both by the shape of abutting front face 212 defining at least a substantially circular surface, as best seen in FIG. 2D, which can be substantially planar or concave relative to plunger 210 to apply the ejection force to a more centrally located area of the inserted cigarette end as described below; by the location and arrangement of plunger 210 and arm 230 such that the actuation movement of switch 245 is transferred substantially in the longitudinal direction, i.e., the longest dimension, of the inserted cigarette 23; and/or by the braking action of spring 250 as it is compressed. This even application of force is important because the cigarette 23 is weakened during smoking. Specifically, the circumferentially arranged and heated blades 120 thermally weaken and lessen the mass of respective underlying, longitudinally extending portions of the cigarette. If for instance the ejection force was applied unevenly to the inserted cigarette end or primarily to the outer circumferential annular region of the inserted end, then these weakened portions of the smoked cigarette could collapse or otherwise fail, possibly causing the cigarette portions of the cigarette to break off, especially if the smoker continues to actuate switch 245 unaware that the cigarette has begun to deform. The front face 212 of plunger 210 can be configured in any alternative manner which achieves a successful ejectment of the thermally weakened cigarette. For example, front face 212 can be shaped to extend across the diameter of, and thus across a central portion of, the inserted cigarette end; across a central portion of the inserted cigarette end; or in any other manner to avoid undue and/or asymmetrical applications of force to a smoked cigarette having thermally weakened outer portions.

If desired, an additional stationary position is provided for plunger 210 such that the entirety of cigarette 23 is retracted into the body of lighter 25 to protect the normally protruding cigarette mouth end from being broken, bent or otherwise damaged during handling and periods of suspended use. To accomplish this retraction, the plunger arm 230 is provided with an additional detent (not shown) between detent 230A and plunger 210 and, if necessary, is lengthened, and track 260 is correspondingly lengthened. This additional detent of the plunger arm 230 is accordingly engaged as discussed to permit cigarette 23 to be completely retracted into the receptacle defined by heater blades 120. It is noted that the preferred total overall length of lighter 25 is such that the unit is hand-held.

The smoker may opt to terminate use of the lighter 25 for a period. As noted above, the lighter 25, and especially its internal components, is vulnerable to dust, moisture, etc. unless some protection is provided. The plunger 210 is preferably positioned to occlude opening or orifice 27 of lighter 25, thereby protecting internal lighter components. To achieve this positioning, the plunger 210 is positioned at a second extended or protective position C, as shown in FIG. 2C. More specifically, the smoker actuates, e.g., manually actuates, the switch 245 and specifically pushes switch 245 in the direction of cigarette ejection, i.e., towards the orifice 27 of lighter 25, to disengage spring biased ball 216 either (a) from arm detent 230A to move from a switch position corresponding to resting or "smoking" position A of plunger 210 to a switch position corresponding to a second extended or protective position C of plunger 210 or (b) from arm detent 230B to move from a switch position corresponding to first extended or eject position B of plunger 210 to a switch position corresponding to a second extended or protective position C of plunger 210. Plunger 245 accordingly translates in this direction. Spring 250 is compressed as sliding actuator 240 moves toward base 50 to brake the motion of plunger 210 toward orifice 27.

Actuation of switch 245 continues until spring biased ball 216 engages arm detent 230C to position plunger stationarily at second extended or protective position C. This second extended or protective position C is located so that plunger 210 occludes orifice 27. For example, the plunger 210 is positioned in the substantially trapezoidal insertion cavity defined by inner walls 177 of cap 83. O-ring 220 forms an air tight seal between the slightly spaced apart cap inner walls 177 and plunger 210. The front face 212 of plunger 210 is preferably substantially flush with orifice 27. Accordingly, the interior of lighter is protected from dust, moisture, etc. which could otherwise enter the open cigarette insertion opening of the lighter and possibly damage components and/or alter subjective qualities of subsequently inserted cigarettes. To resume use, the smoker moves switch 245 away from orifice 27 and preferably releases switch 245 after switch 245 is translated a sufficient distance to disengage biased ball 216 from detent 230C, thereby permitting spring 250 to expand and drive sliding actuator 240, and thus plunger 210 and switch 245, from position C back to position A.

Positions B and C are optionally combined in a single position to eject and, if the detent is stationarily engaged with the spring biased ball 216, to protect the lighter interior. In any event, the light sensor 53 should be positioned so as not to recongize the plunger 210 in an ejection or stationary, protective position, and/or the plunger should not be marked as a triggering or acceptable object.

The corresponding portions of the insertion cavity defined by cap inner walls 177, the base cavity 50A and plunger 210 are similarly sized and shaped, e.g., substantially trapezoidal, to form, along with O-ring 220, a substantially air tight seal to (1) prevent undesired drops in the resistance to draw of the smoking system during smoking when plunger 210 is located within cavity 50A at position A and (2) to protect the lighter interior from dust, moisture, etc. when plunger 210 is located within insertion cavity defined by cap inner walls 177 at position C. Also, the outermost portions of plunger 210 are sized and shaped such that plunger 210 can translate through the cylindrical cavity defined by the heater blades 120.

As the cigarette heating elements 120 are fired to generate a subsequent puff, condensates on the cigarette heating elements 120 from the previous puff(s) are usually dissipated by this heating. The cigarette heating elements can be further cleaned by the movement of plunger 210 from operative or resting position A to one of the extended positions B or C which further clean the inner surfaces of the blades by a scraping motion. If desired, the outermost portions of plunger 210 are sized and shaped to contact the heater blades 120 to scrape and clean the heater blades. The plunger 210 is accordingly sized to achieve such a scraping without exerting undesired forces on the blades during plunger movement.

Alternatively, a plug defining a shape similar to plunger 210 and O-ring 220 but not connected to arm 230 is inserted into orifice 27 to block the lighter opening and protect internal components.

Figure 4:
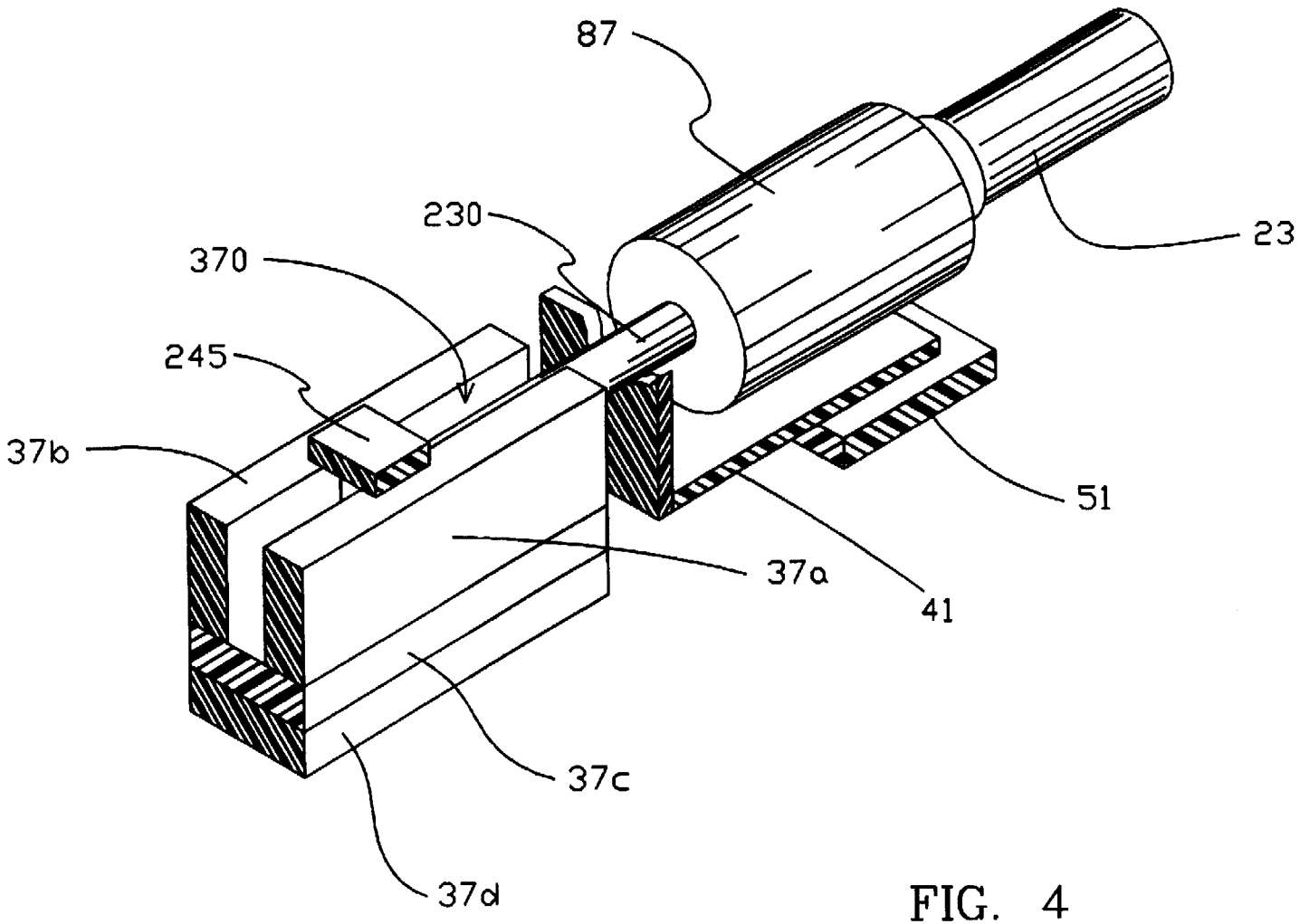
FIG. 4 is an isometric view of a battery arrangement according to the present invention.

As noted above, the overall longitudinal length of the lighter 25 should be such that the unit is conveniently held in the hand of a smoker, e.g., approximately 100 mm, ±approximately 20 mm. The relatively narrower side walls 251 and the relatively wider side walls 252 are also similarly sized, e.g. approximately 23 mm, ±approximately 10 mm, by approximately 37 mm, ±approximately 10 mm. Given current technologies, the batteries 37 have the most significant space requirements of any of the internal components of lighter 25, as seen in FIG. 1. For example, four nickel cadmium batteries 37 are approximately 40 to 48 mm long, 17 mm wide and 5.75 mm thick. Given that plunger arm 230 must be sufficiently long to eject, at least partially, an approximately 60 mm cigarette inserted into the lighter, provisions must be made to achieve the positioning of plunger arm 230 within a hand-held lighter. As shown in FIG. 4, batteries 37 are preferably positioned such that a passageway 370 is defined for plunger arm 230 and sliding actuator 240. Passage 370 thus preferably underlies track 260. Specifically, four rectangular batteries 37*a*–37*d* are provided, each having two parallel first side walls of a first width and two parallel second side walls of a second width greater than the first width, with the first and second side walls being perpendicularly arranged. Two of the batteries, e.g. 37*a* and 37*b*, are arranged such that respective second walls face one another and are separated by a gap. A third battery, e.g., 37*c*, is arranged with one second wall perpendicular to the second walls of the first two batteries 37*a* and 37*b* abutting respective first walls of these batteries 37*a* and 37*b* to define a U-shape arranged to define passage 370. The overlying recessed area 265 and the bottom or back wall of the lighter housing completes the enclosure of plunger arm 230. The fourth battery 37*d* is then arranged such that a second wall thereof is in face-to-face contact with the third battery 37*c*. Accordingly, an optional battery arrangement is provided which permits the provision and actuation of an ejection system according to the present invention in a hand-held lighter 25.

Figure 3A:
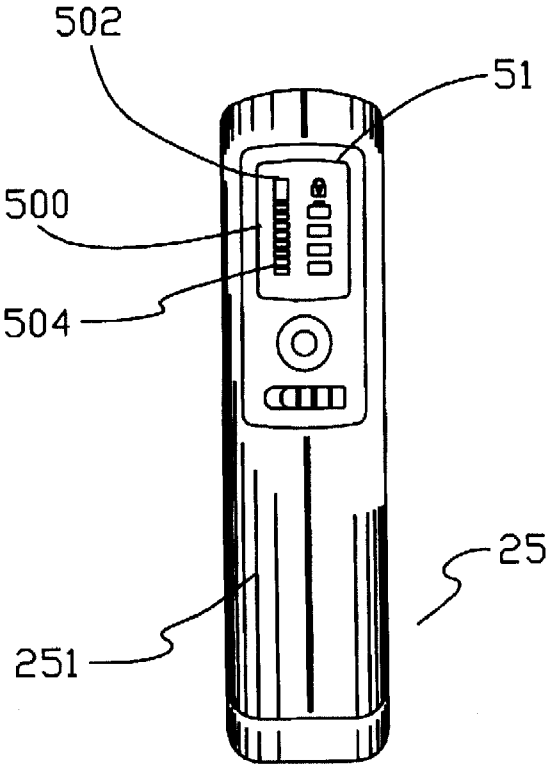
FIG. 3A is a side view of a lighter including an icon display according to the present invention.

Referring to FIG. 3A, a preferred indication or display 51 is depicted, preferably located on one of two narrower walls 251 of generally rectangular housing of lighter 25, and preferably on the one of two narrower housing walls 251 opposite switch 245, to permit viewing as one of two wider walls 252 rests in a smoker's palm. This display 51 is preferably a liquid crystal display which depicts icons indicative of the status of various functions of the lighter 25, and more broadly of the defined smoking system including cigarette 23. For example, icon 500 depicts a cigarette comprising a filter icon 502 defining a rectangular outline, i.e., current is supplied to define the dark outline; and a plurality of, e.g., eight, relatively smaller rectangular shaded areas 504, indicative of puffs remaining on an inserted cigarette 23, i.e., current is initially supplied to all of the rectangles. As a heater blade 120 is fired, current supply is terminated to a corresponding shaded area 504 to cause area 504 to either disappear or to define an outline. Conversely, the areas 504 initially define an outline, and as a heater blade 120 is fired, current supply is terminated to a corresponding outline area 504 to cause area 504 to either disappear or to define a shaded area. Preferably, current supply to the area 504 located at terminal end of cigarette icon 500 opposite filter icon 502 is terminated at the first puff, and then current supply to successively adjacent areas 504 is terminated with successive draw-actuated, heater blade firings to alert the smoker both of the number of puffs remaining and the number of puffs taken on an inserted cigarette. Such iconography also simulates the burning of a combusted cigarette with the lighted end approaching the filter as the cigarette is smoked. If desired, this visual display could be coupled with a conventional tone, beep or other audio signal.

A thumb depression 270 is located on an outer surface of lighter 25, preferably located on at least one and preferably both of two wider walls 252 of generally rectangular housing of lighter 25 to facilitate handling of the lighter by the smoker, e.g., when smoking a cigarette, actuating switch 245 and/or removing a smoked cigarette.

As described more fully in incorporated, copending, commonly assigned patent application Ser. No. 08/380,718, filed Jan. 30, 1995, and U.S. Pat. No. 5,388,594 issued Feb. 14, 1995, when the timer network of logic of circuitry 41 sends a signal through a terminal to a logic circuit indicating that the timer has stopped running, the particular ON FET heater switch is turned OFF, thereby removing power from the heater blade 120. The logic circuit also downcounts and sends a signal to the indicator 51 through a terminal so that the indicator will display that one less puff is remaining (i.e., "7", after the first puff). When the smoker next puffs on the cigarette 23, the logic circuit will turn ON another predetermined one of the FET heater switches, thereby supplying power to another predetermined one of the heater elements. The process will be repeated until the indicator 51 displays "0", meaning that there are no more puffs remaining on the cigarette 23. When the cigarette 23 is removed from the lighter 25, the light sensor 53 indicates that a cigarette is not present, and the logic circuit is reset.

Other features, such as those described in U.S. patent application Ser. No. 07/943,504, which is incorporated by reference, may be incorporated in the control circuitry 41 instead of or in addition to the features described above. For example, if desired, various disabling features may be provided. One type of disabling feature includes timing circuitry (not shown) to prevent successive puffs from occurring too close together, so that the power source 37 has time to recover. Another disabling feature includes means for disabling the heater blades 120 if an unauthorized cigarette or other product is inserted in the heater fixture 39. For example, the cigarette 23 might be provided with an identifying characteristic that the lighter 25 must recognize before the heater blades 120 are energized.

Many modifications, substitutions and improvements may be apparent to the skilled artisan without departing from the spirit and scope of the present invention as described and defined herein and in the following claims.

We claim:

1. An ejector for ejecting a cigarette having a mouth end and a distal end from an electrical smoking system, said ejector comprising, in combination:

a housing for containing a cigarette, said housing having a cylindrical receptacle for receiving a cigarette inserted distal end first via an opening to be heated by the at least one heater such that an opposite cigarette mouth end protrudes from the lighter, and at least one heater contained in said housing, said heater being located in thermal proximity to an inserted cigarette, said heater being actuated responsive to draw on the protruding cigarette mouth end by a consumer to evolve tobacco flavor from said cigarette while inserted in said housing, a movable contact surface, said contact surface having a size such that it may travel longitudinally through the cylindrical receptacle of the lighter and contact at least a central area of the inserted distal end of a cigarette, and an actuator for moving said contact surface between a first position in the cylindrical receptacle to allow insertion of a cigarette and a second position in the cylindrical receptacle to move an inserted cigarette out of the cylindrical receptacle.

2. The ejection system according to claim 1, wherein said contact surface at the first position defines an air flow gap between said contact surface and an inserted end of a cigarette.

3. The ejection system according to claim 1, further comprising a plunger, said plunger defining said contact surface.

4. The ejection system according to claim 1, further comprising means for establishing a substantially air tight seal between the cylindrical receptacle and said plunger at the first position.

5. The ejection system according to claim 1, further comprising means for positioning said contact surface stationarily at the first and second positions.

6. The ejection system according to claim 1, further comprising means for biasing said contact surface from the second position toward the first position.

7. The ejection system according to claim 1, further comprising means for stationarily positioning said contact surface near the opening of the cylindrical receptacle, wherein said contact surface is further sized to occlude the opening of the cylindrical receptacle plunger.

8. The ejection system according to claim 1, further comprising means for occluding the opening of the cylindrical receptacle plunger.

9. The ejection system according to claim 1, further comprising means for establishing a substantially air tight seal between the cylindrical receptacle and ambient when said contact surface is positioned at the opening of the cylindrical receptacle.

10. The ejection system according to claim 1, wherein said contact surface at the first position defines an air flow gap between said contact surface and an inserted end of a cigarette such that the first puff of an inserted cigarette has a resistance to draw of approximately 5 to approximately 12 inches.

11. The ejection system according to claim 1, wherein said means for actuating comprises a switch located on an outer surface of the housing, and an actuation mechanism operatively connected to said switch and to said contact surface.

12. The ejection system according to claim 11, further comprising means for positioning said contact surface stationarily at the first and second positions.

13. The ejection system according to claim 12, wherein said means for positioning comprises at least one detent located on said actuation mechanism and a spring-biased ball for engaging and disengaging said at least one detent.

14. The ejection system according to claim 11, wherein the housing has a longitudinal axis, wherein said switch is movable parallel to the longitudinal axis of the housing.

15. The ejection system according to claim 1, further comprising a channel for travel of said actuation mechanism upon actuation of said switch.

16. The ejection system according to claim 15, wherein said channel is defined at least partially by walls of a power source.

17. The ejection system according to claim 16, wherein said channel is U-shaped.

18. An ejection system for an electrical cigarette lighter comprising at least one heater, a housing surrounding the at least one heater, and a cylindrical receptacle in the housing for receiving a cigarette inserted end first via an opening to be heated by the at least one heater such that an opposite cigarette mouth end protrudes from the lighter, the ejection system comprising:

a contact surface sized to travel longitudinally through the cylindrical receptacle of the lighter and to contact at least a central area of an inserted end of a cigarette, means for actuating said contact surface between a first position in the cylindrical receptacle to allow insertion of a cigarette and a second position in the cylindrical receptacle to move an inserted cigarette out of the cylindrical receptacle, and means for visually informing a smoker that an inserted cigarette has been heated a desired number of times.

19. The ejection system according to claim 18, wherein said means for visually informing comprises means for displaying a cigarette icon and means for correlating the display of said cigarette icon with the number of times an inserted cigarette has been heated.

20. The ejection system according to claim 19, wherein said cigarette icon comprises a filter icon and a plurality of segmented cigarette rod icons.

21. The ejection system according to claim 1, wherein said contact surface is sized to contact a central area extending across a diameter of the inserted end of a cigarette.

22. An electrical cigarette lighter for a cigarette having a mouth end and a distal end, said lighter comprising:

a housing surrounding a cylindrical receptacle for receiving a cigarette inserted end first via an opening;

at least one heater contained in said housing and producing inhalable tobacco flavor from a heated cigarette, said heater actuated in response to a draw on the cigarette from a consumer on an opposite cigarette mouth end which protrudes from the lighter; and an ejection system comprising:

a contact surface sized to travel longitudinally through the cylindrical receptacle of the lighter and to contact the inserted distal end of a cigarette, and means for actuating said contact surface between a first position in the cylindrical receptacle to allow insertion of a cigarette and a second position in the cylindrical receptacle to move an inserted cigarette out of the cylindrical receptacle.

23. The electrical cigarette lighter according to claim 22, wherein said contact surface is sized to contact a central area of the inserted end of a cigarette.

* * * * *